US009580883B2

(12) United States Patent
Singh et al.

(10) Patent No.: US 9,580,883 B2
(45) Date of Patent: Feb. 28, 2017

(54) SYSTEM AND METHOD FOR AUTOMATICALLY CONTROLLING A LIFT ASSEMBLY OF A WORK VEHICLE

(71) Applicant: CNH Industrial America, LLC, New Holland, PA (US)

(72) Inventors: Aditya Singh, Westmont, IL (US); Duqiang Wu, Bolingbrook, IL (US); Navneet Gulati, Naperville, IL (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 14/467,163

(22) Filed: Aug. 25, 2014

(65) Prior Publication Data

US 2016/0053460 A1 Feb. 25, 2016

(51) Int. Cl.

| | |
|---|---|
| ***E02F 3/43*** | (2006.01) |
| ***E02F 3/34*** | (2006.01) |
| ***E02F 9/20*** | (2006.01) |

(52) U.S. Cl.

CPC ..... *E02F 3/434* (2013.01); *E02F 3/3414* (2013.01); *E02F 9/2041* (2013.01)

(58) Field of Classification Search

CPC ..... G07C 5/008; G06F 17/00; E02F 3/433; E02F 3/434; E02F 3/438; F15B 21/08; A01B 79/005; B65G 1/0492; G06Q 10/047

USPC ..... 701/32.3, 50, 99; 414/699, 273, 700

See application file for complete search history.

(56) References Cited

U.S. PATENT DOCUMENTS

| | | | | |
|---|---|---|---|---|
| 3,643,828 A * | 2/1972 | Elliott | F15B 21/08 414/347 |
| 3,726,428 A * | 4/1973 | Lark | E02F 3/434 414/700 |
| 4,015,729 A | 4/1977 | Parquet et al. | |
| 4,984,956 A * | 1/1991 | Ikari | E02F 3/433 414/699 |
| 5,000,650 A * | 3/1991 | Brewer | E02F 3/434 172/812 |

(Continued)

OTHER PUBLICATIONS

John Deere—J Loader 344J—Internet Web Page: http://www.deere.com/en_US/docs/construction/wheelloader/344j/DKA344J.pdf. (pp. 1-16), Dated Sep. 2001.

(Continued)

*Primary Examiner* — Yuri Kan

(74) *Attorney, Agent, or Firm* — Peter K. Zacharias; Patrick M. Sheldrake

(57) ABSTRACT

In one aspect, a method for automatically controlling the operation of a work vehicle during the performance of a material moving operation may generally include monitoring cycle times for moving the work vehicle between a first location and a second location as the material moving operation is being performed and determining a work cycle time for moving the work vehicle between the first and second locations based on the monitored cycle times. In addition, the method may include automatically controlling the operation of a lift assembly of the work vehicle based on the work cycle time such that loader arms and an implement of the lift assembly are moved to a pre-defined loading position as the work vehicle is moved from the first location to the second location and to a pre-defined unloading position as the work vehicle is moved from the second location to the first location.

21 Claims, 5 Drawing Sheets

(56) References Cited

U.S. PATENT DOCUMENTS

| | | | | |
|---|---|---|---|---|
| 5,065,326 | A * | 11/1991 | Sahm | E02F 3/438 340/686.1 |
| 5,701,691 | A | 12/1997 | Watanabe et al. | |
| 6,076,030 | A | 6/2000 | Rowe | |
| 7,726,048 | B2 | 6/2010 | Stanek et al. | |
| 7,832,126 | B2 | 11/2010 | Koellner et al. | |
| 2002/0073833 | A1 | 6/2002 | Coombs et al. | |
| 2008/0077299 | A1* | 3/2008 | Arshad | A01B 79/005 701/50 |
| 2011/0106384 | A1 | 5/2011 | Corke et al. | |
| 2011/0190942 | A1* | 8/2011 | Nicholson | E02F 3/434 700/275 |
| 2013/0096799 | A1* | 4/2013 | Horne | G06F 17/00 701/99 |
| 2013/0108403 | A1* | 5/2013 | Atkinson | E02F 3/434 414/685 |
| 2013/0311153 | A1* | 11/2013 | Moughler | G06Q 10/047 703/6 |
| 2014/0086714 | A1* | 3/2014 | Malik | B65G 1/0492 414/273 |
| 2014/0088820 | A1* | 3/2014 | Jericho | G07C 5/008 701/32.3 |

OTHER PUBLICATIONS

Case—D Series Wheel Loaders—Internet Web Page: http://www.casece.com/en_tr/Gallery/Downloads/xPM_WL_721D/cce_WL_D%20Series_521D_brochure_07-28-2009.pdf. (pp. 1-12), Dated Oct. 25, 2013.

Case—680B Construction King—Internet Web Page: http://www.casece.com/en_anz/Gallery/Down;oads/xPM-LB_680B/cce_LB_B%20Series_680B_specs_06-26-2009.pdf. (pp. 1-4), Dated 2013.

Int. J. Heavy Vehicle Systems. vol. 20, No. 2, 2013. Event-based detection of the digging operation states of a wheel loader earth moving equiptment-Internet Web Page: http://inderscience.metapress.com/content/00u391238081w27j/fulltext.pdf. . (One Page), Dated 2013.

EP15182183, European Search Report and Written Opinion, mailed Feb. 3, 2016, 4 pages.

* cited by examiner

SYSTEM AND METHOD FOR AUTOMATICALLY CONTROLLING A LIFT ASSEMBLY OF A WORK VEHICLE

FIELD OF THE INVENTION

The present subject matter relates generally to work vehicles and, more particularly, to a system and method for automatically controlling a lift assembly of a work vehicle during the performance of a material moving operation.

BACKGROUND OF THE INVENTION

Work vehicles having lift assemblies, such as skid steer loaders, telescopic handlers, wheel loaders, backhoe loaders, forklifts, compact track loaders, bulldozers and the like, are a mainstay of construction work and industry. For example, the lift assembly for a skid steer loader typically includes a pair of loader arms pivotally coupled to the vehicle's chassis that can be raised and lowered at the operator's command using suitable hydraulic cylinders. The loader arms typically have an implement attached to their end, thereby allowing the implement to be moved relative to the ground as the loader arms are raised and lowered. For example, a bucket is often coupled to the loader arm, which allows the skid steer loader to be used to perform material moving operations, wherein a given material, such as sand, dirt, gravel, rocks or any other material, is moved from one location to another.

When performing a material moving operation, operators typically prefer that the loader arms and bucket be properly positioned for dumping the loaded material when the work vehicle reaches the location at which the material is being unloaded (e.g., into the back of a truck or onto a conveyor). Similarly, it is preferred that the loader arms and bucket be properly positioned for digging or scooping up material when the work vehicle reaches the source location of the material. Unfortunately, current control strategies are not equipped to automatically move the loader arms and the bucket to the desired positions as the work vehicle is being moved without causing excessive jerkiness resulting from adjusting the position of the loader arms/bucket too quickly or without requiring the operator to pause due to movement of the loader arms/bucket being too slow.

Accordingly, an improved system and method for controlling a lift assembly of a work vehicle during the performance of a material moving operation that allows for the operational speed of the lift assembly to be synchronized with the speed at which the work vehicle is being moved between the locations for loading and unloading material would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a method for automatically controlling the operation of a work vehicle during the performance of a material moving operation, wherein the work vehicle includes a lift assembly having a pair of loader arms coupled to an implement. The method may generally include monitoring, with a computing device, cycle times for moving the work vehicle between a first location and a second location as the material moving operation is being performed and determining a work cycle time for moving the work vehicle between the first and second locations based on the monitored cycle times. In addition, the method may include automatically controlling the operation of the lift assembly based on the work cycle time such that the loader arms and the implement are moved to a pre-defined loading position as the work vehicle is moved from the first location to the second location and to a pre-defined unloading position as the work vehicle is moved from the second location to the first location.

In another aspect, the present subject matter is directed to a system for automatically controlling the operation of a work vehicle during the performance of a material moving operation. The system may generally include a drive unit configured to move the work vehicle between a first location and a second location and a lift assembly including a pair of loader arms and an implement coupled to the loader arms. In addition, the system may include a controller communicatively coupled to the drive unit and the lift assembly. The controller may be configured to monitor cycle times for moving the work vehicle between the first and second locations as the material moving operation is being performed. The controller may also be configured to determine a work cycle time for moving the work vehicle between the first and second locations based on the monitored cycle times. Moreover, the controller may be configured to automatically control the operation of the lift assembly based on the work cycle time such that the loader arms and the implement are moved to a pre-defined loading position as the work vehicle is moved from the first location to the second location and to a pre-defined unloading position as the work vehicle is moved from the second location to the first location.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
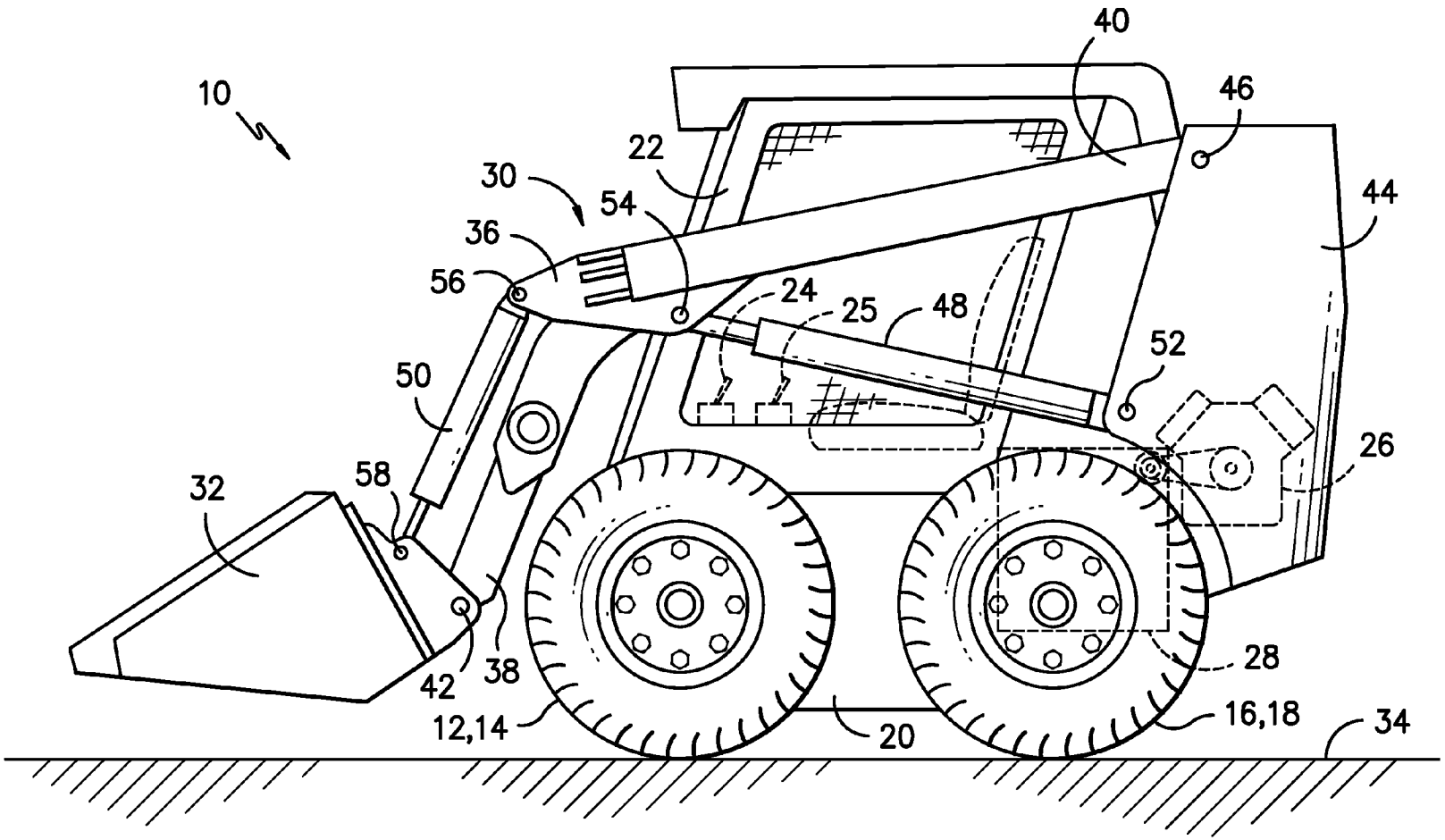
FIG. 1 illustrates a side view of one embodiment of a work vehicle.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
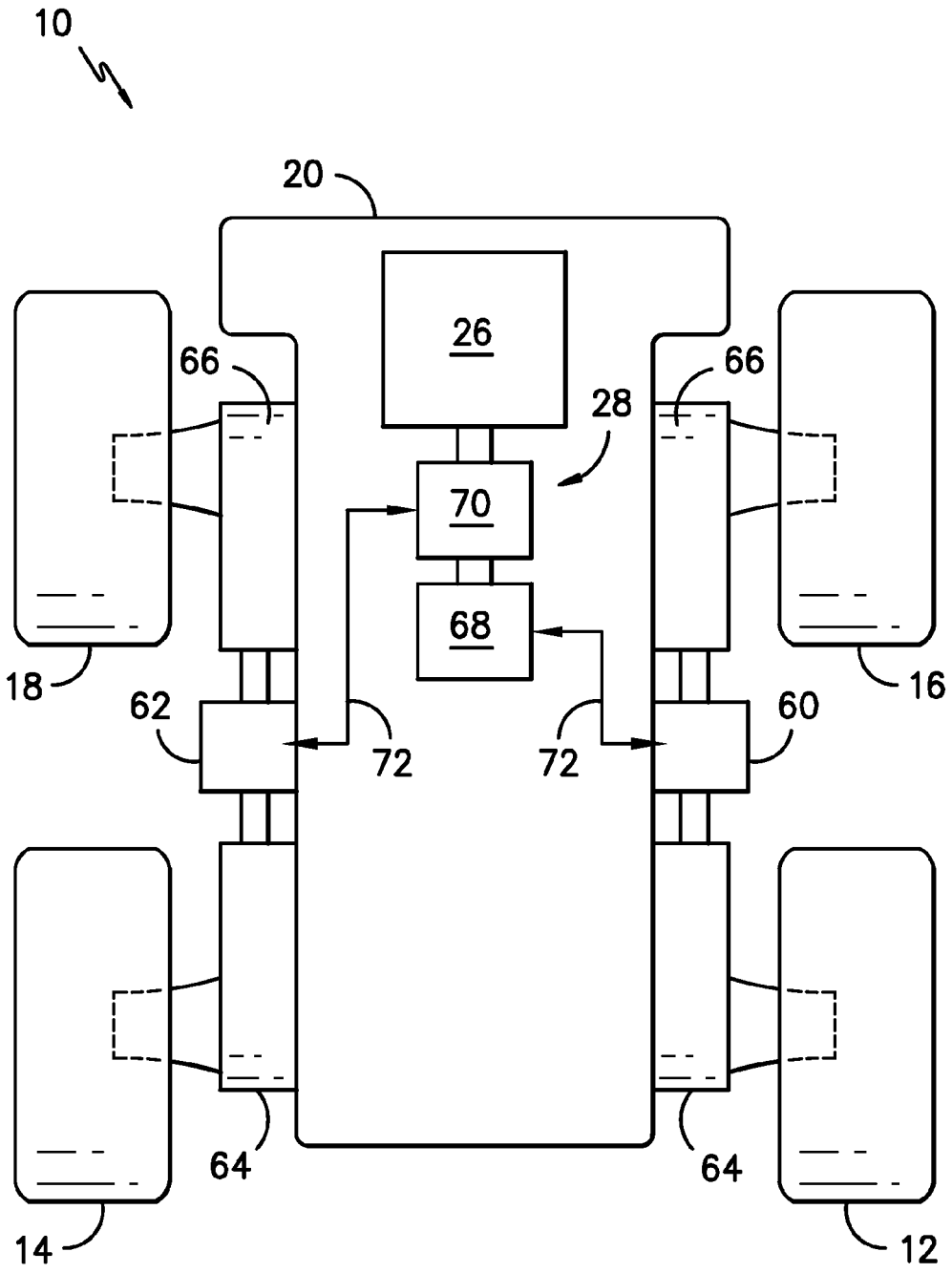
FIG. 2 illustrates a schematic view of various components of the work vehicle shown in FIG. 1, including a hydrostatic drive unit of the work vehicle.

Referring now to the drawings, FIGS. 1 and 2 illustrate different views of one embodiment of a work vehicle 10. Specifically, FIG. 1 illustrates a side view of the work vehicle 10 and FIG. 2 illustrates a schematic view of various components of the work vehicle 10 shown in FIG. 1. As shown, the work vehicle 10 is configured as a skid steer loader. However, in other embodiments, the work vehicle 10 may be configured as any other suitable work vehicle known in the art, such as any other vehicle including a lift assembly that allows for the maneuvering of an implement (e.g., telescopic handlers, wheel loaders, backhoe loaders, forklifts, compact track loaders, bulldozers and/or the like).

As shown, the work vehicle 10 includes a pair of front wheels 12, 14, a pair of rear wheels 16, 18 and a chassis 20 coupled to and supported by the wheels 12, 14, 16, 18. An operator's cab 22 may be supported by a portion of the chassis 20 and may house various input devices, such as one or more speed control lever(s) 24 and one or more lift/tilt lever(s) 25, for permitting an operator to control the operation of the work vehicle 10. In addition, the work vehicle 10 may include an engine 26 and a hydrostatic drive unit 28 coupled to or otherwise supported by the chassis 20.

Moreover, as shown in FIG. 1, the work vehicle 10 may also include a lift assembly 30 for raising and lowering a suitable implement 32 (e.g., a bucket) relative to a driving surface 34 of the vehicle 10. In several embodiments, the lift assembly 30 may include a pair of loader arms 36 (one of which is shown) pivotally coupled between the chassis 20 and the implement 32. For example, as shown in FIG. 1, each loader arm 36 may be configured to extend lengthwise between a forward end 38 and an aft end 40, with the forward end 38 being pivotally coupled to the implement 32 at a forward pivot point 42 and the aft end 40 being pivotally coupled to the chassis 20 (or a rear tower(s) 44 coupled to or otherwise supported by the chassis 20) at a rear pivot point 46.

In addition, the lift assembly 30 may also include a pair of hydraulic lift cylinders 48 coupled between the chassis 20 (e.g., at the rear tower(s) 44) and the loader arms 36 and a pair of hydraulic tilt cylinders 50 coupled between the loader arms 36 and the implement 32. For example, as shown in the illustrated embodiment, each lift cylinder 48 may be pivotally coupled to the chassis 20 at a lift pivot point 52 and may extend outwardly therefrom so to be coupled to its corresponding loader arm 36 at an intermediate attachment location 54 defined between the forward and aft ends 38, 40 of each loader arm 36. Similarly, each tilt cylinder 50 may be coupled to its corresponding loader arm 36 at a first attachment location 56 and may extend outwardly therefrom so as to be coupled to the implement 32 at a second attachment location 58.

It should be readily understood by those of ordinary skill in the art that the lift and tilt cylinders 48, 50 may be utilized to allow the implement 32 to be raised/lowered and/or pivoted relative to the driving surface 34 of the work vehicle 10. For example, the lift cylinders 48 may be extended and retracted in order to pivot the loader arms 36 upward and downwards, respectively, about the rear pivot point 52, thereby at least partially controlling the vertical positioning of the implement 32 relative to the driving surface 34. Similarly, the tilt cylinders 50 may be extended and retracted in order to pivot the implement 32 relative to the loader arms 36 about the forward pivot point 42, thereby controlling the tilt angle or orientation of the implement 32 relative to the driving surface 34. As will be described below, such control of the positioning and/or orientation of the various components of the lift assembly 30 may allow for the loader arms 36 and/or the implement 32 to be automatically moved to one or more pre-defined positions during operation of the work vehicle 10. For example, when the work vehicle 10 is being utilized to perform a material moving operation, such as moving dirt from a dirt pile and dumping it into the back of a truck, the loader arms 36 and the implement 32 may be automatically moved between a digging or loading position and a dumping or unloading position as the vehicle 10 is moved between the dirt pile and the truck in order to improve the overall efficiency of the work vehicle 10 when performing the material moving operation.

Referring particularly now to FIG. 2, the hydrostatic drive unit 28 of the work vehicle 10 may include a pair of hydraulic motors (e.g., a first hydraulic motor 60 and a second hydraulic motor 62), with each hydraulic motor 60, 62 being configured to drive a pair of wheels 12, 14, 16, 18. For example, the first hydraulic motor 60 may be configured to drive the left-side wheels 12, 16 via front and rear axles 64, 66, respectively. Similarly, the second hydraulic motor 62 may be configured to drive the right-side wheels 14, 18 via front and rear axles 64, 66, respectively. Alternatively, the motors 60, 62 may be configured to drive the wheels 12, 14, 16, 18 using any other suitable means known in the art. For instance, in another embodiment, the motors 60, 62 may be coupled to the wheels via a suitable sprocket/chain arrangement (not shown) as opposed to the axles 64, 66 shown in FIG. 2.

Additionally, the hydrostatic drive unit 28 may include a pair of hydraulic pumps (e.g., a first hydraulic pump 68 and a second hydraulic pump 70) driven by the engine 26, which may, in turn, supply pressurized fluid to the motors. For example, as shown in FIG. 2, the first hydraulic pump 68 may be fluidly connected to the first motor 60 (e.g., via a suitable hydraulic hose or other fluid coupling 72) while the second hydraulic pump 70 may be fluidly connected to the second motor 62 (e.g., via a suitable hydraulic hose or other fluid coupling 72). As such, by individually controlling the operation of each pump 68, 70, the speed of the left-side wheels 12, 16 may be regulated independent of the right-side wheels 14, 18.

It should be appreciated that the configuration of the work vehicle 10 described above and shown in FIGS. 1 and 2 is provided only to place the present subject matter in an exemplary field of use. Thus, it should be appreciated that the present subject matter may be readily adaptable to any manner of work vehicle configuration.

Figure 3:
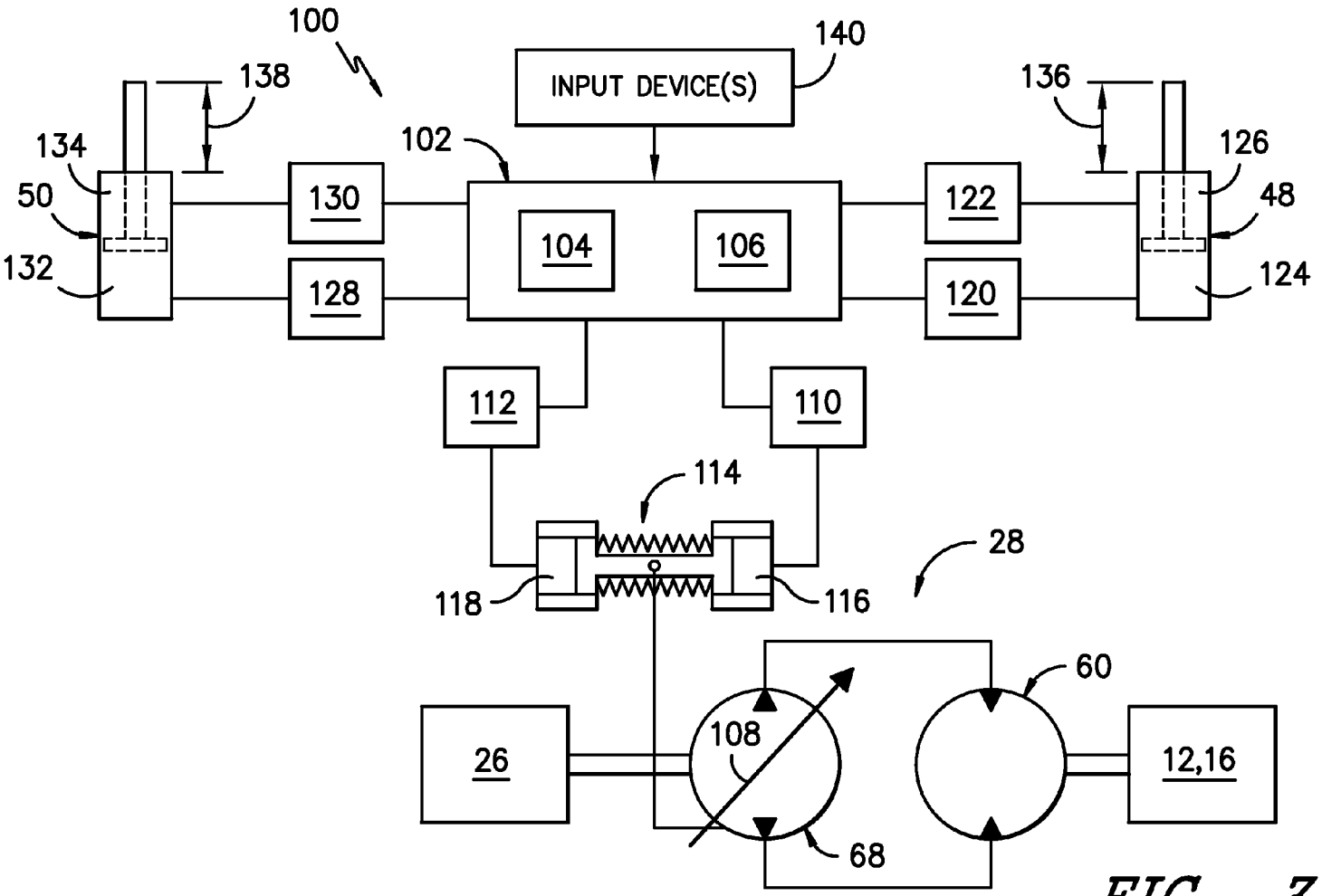
FIG. 3 illustrates a schematic view of one embodiment of a suitable control system for controlling various components of a work vehicle in accordance with aspects of the present subject matter, particularly illustrating the control system configured for controlling various hydraulic components of the work vehicle, such as the hydrostatic drive unit and the hydraulic cylinders of the work vehicle.

Referring now to FIG. 3, one embodiment of a control system 100 suitable for controlling the various components of a work vehicle is illustrated in accordance with aspects of the present subject matter. In general, the control system 100 will be described herein with reference to the work vehicle 10 described above with reference to FIGS. 1 and 2. However, it should be appreciated by those of ordinary skill in the art that the disclosed system 100 may generally be utilized to the control one or more components of any suitable work vehicle.

As shown, the control system 100 includes a controller 102 configured to electronically control the operation of one or more components of the work vehicle 10, such as the various hydraulic components of the work vehicle 10 (e.g., the hydrostatic unit 28, the lift cylinder 48 and the tilt cylinder 50). In general, the controller 102 may comprise any suitable processor-based device known in the art, such a computing device or any suitable combination of computing devices. Thus, in several embodiments, the controller 102 may include one or more processor(s) 104 and associated memory device(s) 106 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 106 of the controller 102 may generally comprise memory element(s) including, but are not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 106 may generally be configured to store suitable computer-readable instructions that, when implemented by the processor(s) 104, configure the controller 102 to perform various computer-implemented functions, such as the method 200 described below with reference to FIG. 5. In addition, the controller 102 may also include various other suitable components, such as a communications circuit or module, one or more input/output channels, a data/control bus and/or the like.

It should be appreciated that the controller 102 may correspond to an existing controller of the work vehicle 10 or the controller 102 may correspond to a separate processing device. For instance, in one embodiment, the controller 102 may form all or part of a separate plug-in module that may be installed within the work vehicle 10 to allow for the disclosed system and method to be implemented without requiring additional software to be uploaded onto existing control devices of the vehicle 10.

As shown in FIG. 3, the controller 102 may be communicatively coupled to various components for controlling the operation of the hydraulic pumps 68, 70 (and, thus, the hydraulic motors 60, 62) of the hydrostatic drive unit 28. Specifically, the controller 102 is shown in the illustrated embodiment as being coupled to suitable components for controlling the operation of the first hydraulic pump 68 and the first hydraulic motor 60, thereby allowing the controller 102 to electronically control the speed/direction of the left-side wheels 12, 16. However, it should be appreciated that the controller 102 may also be communicatively coupled to similar components for controlling the operation of the second hydraulic pump 70 and the second hydraulic motor 62, thereby allowing the controller 102 to electronically control the speed/direction of the right-side wheels 14, 18.

For example, to change the rotational speed of the motor 60 (and, thus, the rotational speed of the wheels 12, 16), the displacement of the associated hydraulic pump 68 may be varied by adjusting the position or angle of a swashplate (indicated by the arrow 108) of the pump 68, thereby adjusting the flow of hydraulic fluid to the motor 60. Similarly, to electronically control the displacement of the swashplate 108, the controller 102 may be commutatively coupled to suitable pressurize regulating valves 110, 112 (PRVs) (e.g., solenoid-activated valves) configured to regulate the pressure of hydraulic fluid supplied to a control piston 114 of the pump 68. Specifically, as shown schematically in FIG. 3, the controller 102 may be coupled to both a forward PRV 110 configured to regulate the pressure of the hydraulic fluid supplied to a forward chamber 116 of the control piston 114 and a reverse PRV 112 configured to regulate the pressure of the hydraulic fluid supplied to a reverse chamber 118 of the control piston 114. Thus, by pressurizing the forward chamber 116, the swashplate 108 of the pump 68 may be displaced such that hydraulic fluid flows through the fluid loop defined by the hydrostatic drive unit 28 in a manner that causes the motor 60 to drive the wheels 12, 16 in the forward direction. Similarly, by pressurizing the reverse chamber 118, the swashplate 108 may be displaced such that hydraulic fluid flows through the fluid loop in a manner that causes the motor 60 to drive the wheels 12, 16 in the reverse direction.

In addition, the controller 102 may be configured to similarly control the operation of the hydraulic lift and tilt cylinders 48, 60. For example, in several embodiments, the controller 102 may be communicatively coupled to suitable valves 120, 122 (e.g., solenoid-activated valves) configured to control the supply of hydraulic fluid to each lift cylinder 48 (only one of which is shown in FIG. 3). Specifically, as shown in the illustrated embodiment, the system 100 may include a first lift valve 120 for regulating the supply of hydraulic fluid to a cap end 124 of each lift cylinder 38. In addition, the system 100 may include a second lift valve 122 for regulating the supply of hydraulic fluid to a rod end 126 of each lift cylinder 48. Moreover, the controller 102 may be communicatively coupled to suitable valves 128, 130 (e.g., solenoid-activated valves) configured to regulate the supply of hydraulic fluid to each tilt cylinder 50 (only one of which is shown in FIG. 3). For example, as shown in the illustrated embodiment, the system 100 may include a first control valve 128 for regulating the supply of hydraulic fluid to a cap end 132 of each tilt cylinder 50 and a second control valve 130 for regulating the supply of hydraulic fluid to a rod end 134 of each tilt cylinder 50.

During operation, the controller 102 may be configured to control the operation of each valve 120, 122, 128, 130 in order to control the flow of hydraulic fluid supplied to each of the cylinders 48, 50. For instance, the controller 102 may be configured to transmit suitable control commands to the lift valves 120, 122 in order to regulate the flow of hydraulic fluid supplied to the cap and rod ends 124, 126 of each lift cylinder 48, thereby allowing for control of a stroke length 136 of the piston rod associated with each cylinder 48. Of course, similar control commands may be transmitted from the controller 102 to the control valves 128, 130 in order to control a stroke length 138 of the tilt cylinders 50. Thus, by carefully controlling the actuation or stroke length 136, 138 of the lift and tilt cylinders 48, 50, the controller 102 may, in turn, be configured to automatically control the manner in which the loader arms 36 and the implement 32 are positioned or oriented relative to the vehicle's driving surface 34.

It should be appreciated that the current commands provided by the controller 102 to the various valves 110, 112, 120, 122, 128, 130 may be in response to inputs provided by the operator via one or more input devices 140. For example, one or more input devices 140 (e.g., the speed lever(s) 24 shown in FIG. 1) may be provided within the cab 22 to allow the operator to provide operator inputs associated with controlling the speed and/or direction of travel of the vehicle 10 (e.g., by varying the current commands supplied to the forward and/or reverse PRVs 110, 112 based on operator-initiated changes in the position of the speed lever(s) 24). Similarly, one or more input devices 140 (e.g., the lift/tilt lever(s) 25 shown in FIG. 1) may be provided within the cab 22 to allow the operator to provide operator inputs associated with controlling the position of the loader arms 36 and the implement 32 relative to the vehicle's driving surface 34 (e.g., by varying the current commands supplied to the lift and/or tilt valves 120, 122, 128, 130 based on operator-initiated changes in the position of the lift/tilt lever(s) 25).

Figure 4:
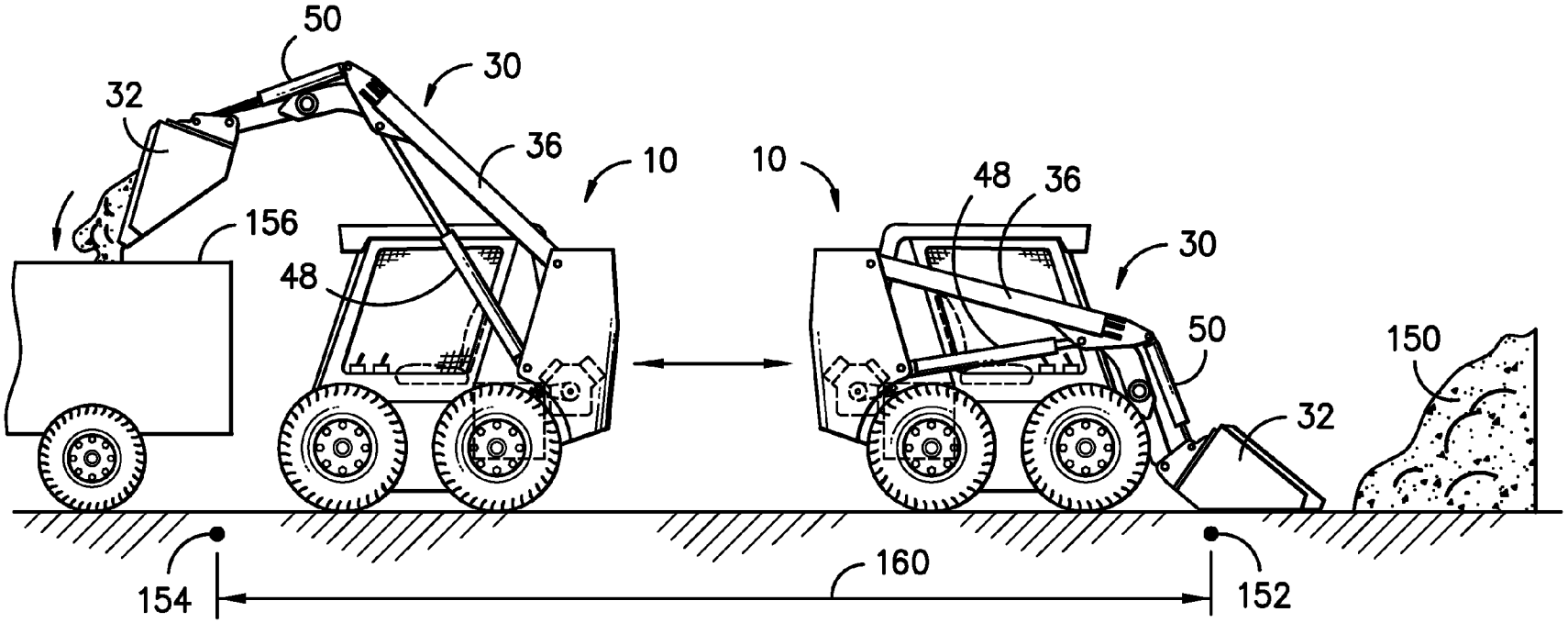
FIG. 4 illustrates an example view of a work vehicle performing a material moving operation in accordance with aspects of the present subject matter.

Additionally, in several embodiments, the controller 102 may be configured to store information associated with pre-defined position settings for the loader arms 36 and/or the implement 32. For example, pre-defined loading and unloading positions may be stored within the controller's memory 106 that correspond to pre-programmed factory settings and/or operator defined position settings. Specifically, the loading position may be selected such that the loader arms 36 and implement 32 are properly positioned for initiating a loading action that allows material to be placed within the implement 32, such as a scooping or digging action. For instance, FIG. 4 illustrates one example of a suitable loading position (on the right side of FIG. 4) for a work vehicle 10 performing a material moving operation. Similarly, the unloading position may be selected such that the loader arms 26 and implement 32 are properly positioned for initiating an unloading action that allows material to be removed from the implement 32, such as a dumping action. For instance, FIG. 4 illustrates one example of a suitable unloading position (on the left side of FIG. 4) for a work vehicle performing a material moving operation.

As indicated above, the loading and unloading positions may, in one embodiment, correspond to operator-defined position settings. For example, to perform a particular operation, the operator may desire that the loader arms 36 and/or implement 32 be located at a specific location(s) at the initiation of a loading and/or unloading action. In such instance, the operator may be able to position the loader arms 36 and the implement 32 at the desired loading and/or unloading position and subsequently provide an operator input (e.g., by pressing a button located within the cab 22) to indicate to the controller 102 that the current positions of the loader arms 36 and the implement 32 should be saved as the new loading position or unloading position. Thereafter, as the material moving operation is being performed, the operator may simply provide a suitable input instructing the controller 102 to automatically move the loader arms 36 and/or the implement 32 to one of the previously stored positions.

Moreover, in accordance with aspects of the present subject matter, the controller 102 may also be configured to store information that allows it to control the lift assembly 30 such that the loader arms 36 and the implement 32 are automatically moved to the loading position or the unloading position as the work vehicle 10 is being moved to a suitable location for loading or unloading material, respectively. Specifically, as will be described below, the controller 102 may store information associated with the cycle times of the work vehicle 10 as it is being moved between a first location (e.g., a location at or adjacent to a source of material to be moved) and a second location (e.g., a location at or adjacent to where the material is being moved) during the performance of a material moving operation. The cycle times may then be analyzed to determine a work cycle time for performing the material moving operation. Thereafter, the controller 102 may be configured to adjust the operational speed of the lift assembly 30 (e.g., via controlling the valves 120, 122, 128, 130 associated with the lift and tilt cylinders 48, 50) such that the loader arms 36 and implement 32 are moved to one of the stored positions in the time it takes for the work vehicle 10 to move between the first and second locations.

Referring now to FIG. 4, an example view of a work vehicle 10 performing a material moving operation is illustrated in accordance with aspects of the present subject matter. As shown, it may be desirable to utilize the work vehicle 10 to move a given amount of material 150 (e.g., dirt, sand, rocks, mulch, etc.) located at or adjacent to a first location 152 to a different, second location 154 (e.g., by moving the material to the back of a dump truck 164 or onto a conveyor). Conventionally, to perform such an operation, the operator controls the positioning of the loader arms 36 and/or the implement 32 so that a volume of material 150 may be scooped, dug up or otherwise loaded into the implement 32 while the work vehicle 10 is positioned at or adjacent to the first location 152. Thereafter, the operator moves the work vehicle 10 to the second location 154 to unload the material 150. Typically, as the work vehicle 10 is being moved, it is desirable to adjust positioning of the loader arms 36 and the implement 32 to a suitable unloading position so that the material 150 may be dumped or otherwise unloaded at the second location 154. This is often done by providing an operator input instructing the controller 102 to automatically adjust the position of the loader arms 36 and the implement 32 to the pre-defined unloading position. Unfortunately, the speed at which the loader arms 36 and the implement 32 are moved to the unloading position is often too fast (resulting in jerky operation as the vehicle 10 is being moved) or too slow (resulting in down time while the operator waits for the lift assembly 30 to get into the proper position). Similarly, after the material is dumped at the second location 156, the operator then begins to move the work vehicle 10 back to the first location 150 and provides a suitable operator input instructing the controller 102 to adjust the position of the loader arms 36 and the implement 32 to the pre-defined loading position. Again, using conventional control strategies, the speed at which the loader arms 36 and the implement 32 are moved to the loading position by the controller 102 is often too fast or too slow, resulting in undesirable operation and/or an undesirable delay. The process is then repeated until the desired amount of material has been moved.

In accordance with aspects of the present subject matter, the disclosed system 100 may be capable of learning or otherwise gathering information about the repeated cycle being performed during the material moving operation and, based on such information, intelligently and automatically control the operation of the lift assembly 30 so that the loader arms 36 and the implement 32 are moved to the proper positions for loading and unloading the material 150 as the work vehicle 10 is being moved between the first and second locations 152, 154. Specifically, in several embodiments, the operator may provide an input instructing the controller 102 to implement a learning or monitoring mode in which the controller 102 monitors the cycle times for the work vehicle 10 as it is initially being moved between the first and second locations 152, 154 during the performance of the material moving operation. For example, the controller 102 may monitor and record the amount of time it takes for the work vehicle 10 to move from the first location 152 to the second location 154 when moving a load of material 150 as well as the amount of time it takes for the work vehicle 10 to move from the second location 154 back to the first location 152 when returning for another load of material 150.

By monitoring such cycle times over a short period of time, the controller 102 may be configured to determine a work cycle time(s) for moving the work vehicle 10 between the first and second locations 152, 154. For instance, in one embodiment, the controller 102 may be configured to average the cycle times recorded when moving the work vehicle 10 from the first location 152 to the second location 154 to determine an average work cycle time for moving a load of material to the second location 154. In addition, the controller 102 may be configured to average the cycle times recorded when moving the work vehicle 10 from the second location 154 to the first location 152 to determine an average work cycle time for returning to pick up another load. Alternatively, the controller 102 may simply be configured to average all of the cycle times recorded in order to determine an overall average cycle time for moving the work vehicle 10 between the first and second locations 152, 154.

Based on the determined work cycle time(s), the controller 102 may then select a suitable speed(s) at which the loader arms 36 and/or the implement 32 must be moved so that the position of such components is properly adjusted as the work vehicle 10 is moved between the first and second locations 152, 154. Specifically, the operational speed(s) of the lift assembly 30 may be selected so that the loader arms 36 and the implement 32 are moved within the time period corresponding to the work cycle time(s) from their current position (e.g., the position of such components after a load of material is received within the implement 32) to the unloading position as the work vehicle 10 is moved from the first location 152 to the second location 154, thereby ensuring that the loader arms 36 and the implement 32 are properly positioned at the unloading position when the work vehicle 10 reaches the second location 154. Similarly, the operational speed(s) of the lift assembly 30 may be selected so that the loader arms 36 and the implement 32 are moved within the time period corresponding to the work cycle time(s) from their current position (e.g., the position of such components are dumpling the material) to the loading position as the work vehicle 10 is moved from the second location 154 to the first location 152, thereby ensuring that the loader arms 36 and the implement 32 are properly positioned at the loading position when the work vehicle arrives back at the first location 152.

It should be appreciated that the movement speeds for the loader arms 36 and the implement 32 may be determined by the controller 102 using any suitable means and/or methodology. For example, by knowing both the current position of the loader arms 36 and the implement 32 and the specific positions of such components when at the loading and unloading positions as well as by understanding the geometry/configuration of the lift assembly 30, a suitable a mathematical relationship(s) and/or data table(s) may be developed and stored within the controller 102 that allows it to calculate the speed(s) at which the loader arms 36 and the implement 32 must be moved based on the determined work cycle time(s). As a result, once the work cycle time(s) is identified, the controller 102 may simply calculate or look-up the speed(s) using the mathematical relationship(s) and/or the data table(s).

It should also be appreciated that the first and second locations 152, 154 may generally correspond to any suitable locations that require some type of vehicle movement to occur when traveling between such locations. For example, as shown in FIG. 4, in one embodiment, the first and second locations 152, 154 may be spaced apart by a horizontal travel distance 160. Alternatively, the first and second locations 152, 154 may simply be rotationally offset from one another, such as by corresponding to locations that only require the work vehicle 10 to be turned or rotated by a given degree (e.g., a 90 or 180 degree rotation).

Figure 5:
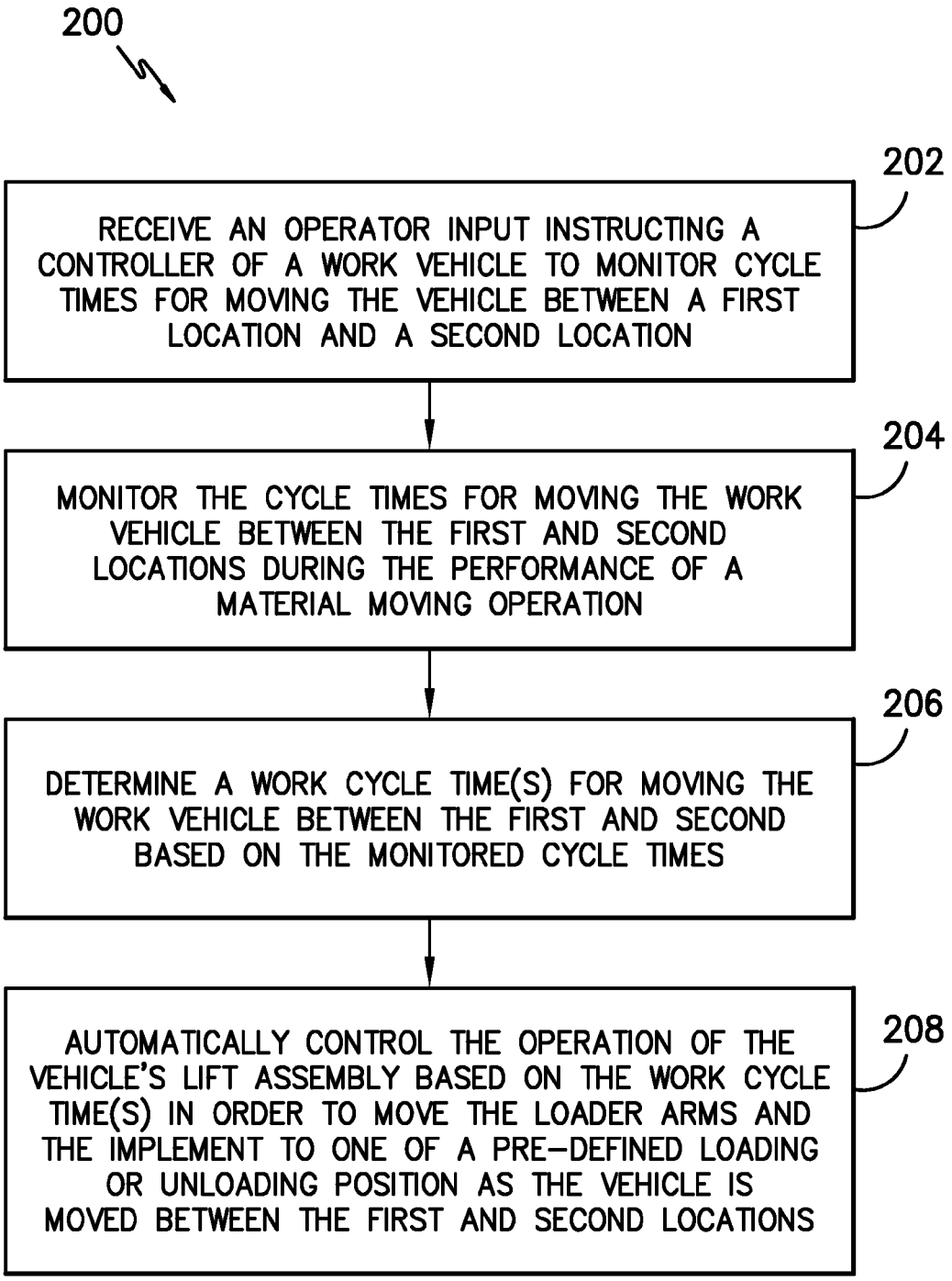
FIG. 5 illustrates a flow diagram of one embodiment a method for automatically controlling the operation of a work vehicle during the performance of a material moving operation in accordance with aspects of the present subject matter.

Referring now to FIG. 5, one embodiment of a method 200 for automatically controlling the operation of a work vehicle during the performance of a material moving operation is illustrated in accordance with aspects of the present subject matter. In general, the method 200 will be described herein with reference to the work vehicle 10 and related control system 100 described above with reference to FIGS. 1-3. However, it should be appreciated by those of ordinary skill in the art that the disclosed method 200 may generally be utilized to control the lift assembly of any suitable work vehicle having any suitable configuration and/or using any suitable control system. In addition, although FIG. 5 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 5, at (202), the method 200 may include receiving an operator input instructing a controller of a work vehicle to monitor cycle times for moving the vehicle between a first location and a second location during the performance of a material moving operation. Specifically, as indicated above, when initiating a material moving operation, the operator may provide a suitable input (e.g., via a button or other input device located within the cab 22) that instructs the vehicle's controller to implement a learning or monitoring mode in which the controller monitors the cycle times for moving between a first loading location (e.g., the location of the source of the material) and a second unloading location (e.g., the location to which the material is being moved).

Additionally, at (204), the method 200 may include actually monitoring the cycle times for moving the work vehicle between the first and second locations. For instance, once a load of material is picked up with the implement 32 at the first location, the controller 102 may monitor the time required to move the work vehicle 10 from the first location to the second location. Similarly, once the load of material is dumped at the second location, the controller 102 may monitor the time required to move the work vehicle 10 from the second location back to the first second location. Such cycle times may then be stored within the controller's memory 140 for subsequent use.

Moreover, at (206), the method 200 may include determining a work cycle time(s) for moving the work vehicle between the first and second locations based on the monitored cycle times. For example, as indicated above, the controller 102 may be configured to average the monitored cycle times in order to define a work cycle time(s) for moving the work vehicle 10 between the first and second locations. In one embodiment, the controller 102 may calculate a single work cycle time for moving between the first and second locations, such as by averaging all of the cycle times recorded by the controller 102. Alternatively, the controller 102 may be configured to calculate separate work cycle times depending on whether the vehicle 10 is being moved from the first location to the second location or from the second location to the first location, such as by averaging the cycles times for moving the vehicle 10 from the first location to the second location to define a first work cycle time and averaging the cycles times for moving the vehicle 10 from the second location back to the first location to define a second work cycle time.

It should be appreciated that, in other embodiments, the work cycle time(s) need not correspond to an average of all of the monitored cycle times, but, rather, may correspond to any other suitable time(s) determined based on the monitored cycle times. For instance, in one embodiment, the work cycle time may correspond to a median cycle time for the monitored cycle times or an averaged cycle time that excludes one or more of the highest and/or lowest monitored cycle times.

Referring still to FIG. 5, at (208) the method 200 may include automatically controlling the operation of the vehicle's lift assembly based on the work cycle time such that the loader arms and the implement are moved to a pre-defined loading position as the work vehicle is moved from the first location to the second location and to a pre-defined unloading position as the work vehicle is moved from the second location to the first location Specifically, as indicated above, the controller 102 may be configured to control the operational speed of the various components of the lift assembly 30 such that, as the work vehicle 10 is moved from the first location to the second location, the loader arms 36 and the implement 32 are moved from their then current position (e.g., the position of such components after scooping or digging up material) to the pre-defined unloading position. Similarly, as the work vehicle 10 is moved from the second location back to the first location, the controller 102 may be configured to control the operational speed of the various components of the lift assembly 30 such that the loader arms 36 and the implement 32 are moved from their then current position (e.g., the position of such components after dumping the material) to the pre-defined loading position.

In several embodiments, such automatic control of the operation of the lift assembly 30 may be in response to an operator input instructing the controller 102 to move the loader arms 36 and the implement 32 to either the pre-defined loading position or the pre-defined unloading position. For instance, once material has been loaded into or otherwise received within the implement 32, the operator may provide a suitable input (e.g., by pressing a button or using any other suitable input device) indicating that the loader arms 36 and the implement 32 need to be moved to the unloading position. Thereafter, as the operator controls the hydrostatic drive unit 28 in order to move the work vehicle 10 from the first location to the second location, the lift assembly 30 may be automatically controlled so that the loader arms 36 and the implement 32 are moved to the unloading position within the determined work cycle time. Similarly, once the material has been unloaded from the implement 32 at the second location, the operator may provide a suitable input (e.g., by pressing a button or using any other suitable input device) indicating that the loader arms 36 and the implement 32 need to be moved now to the loading position. Thereafter, as the operator controls the hydrostatic drive unit 28 in order to move the work vehicle 10 from the second location to the first location, the lift assembly 30 may be automatically controlled so that the loader arms 36 and the implement 32 are moved to the loading position within the determined work cycle time.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for automatically controlling the operation of a work vehicle during the performance of a material moving operation, the work vehicle include a lift assembly having a pair of loader arms coupled to an implement, the method comprising:

monitoring, with a computing device, cycle times for moving the work vehicle between a first location and a second location as the material moving operation is being performed, the first location being spaced apart from the second location such that a horizontal travel distance is defined between the first and second locations;

determining, with the computing device, at least one work cycle time for moving the work vehicle between the first and second locations based on the monitored cycle times;

automatically selecting, with the computing device, an operational speed for the lift assembly based on the at least one work cycle time; and automatically controlling, with the computing device, the operation of the lift assembly based on the selected operational speed such that the loader arms and the implement are moved to a pre-defined loading position as the work vehicle is moved from the first location to the second location and to a pre-defined unloading position as the work vehicle is moved from the second location to the first location.

2. The method of claim 1, wherein determining the at least one work cycle time comprises determining an average cycle time based on the monitored cycle times.

3. The method of claim 1, wherein automatically selecting the operational speed for the lift assembly comprises selecting the operational speed based on the at least one work cycle time such that the loader arms and the implement are moved from their current position to the pre-defined unloading position within the at least one work cycle time.

4. The method of claim 3, further comprising receiving an operator input instructing the computing device to automatically control the operation of the lift assembly in a manner so that the loader arms and the implement are moved from their current position to the predefined unloading position.

5. The method of claim 1, wherein automatically selecting the operational speed for the lift assembly comprises selecting the operational speed based on the at least one work cycle time such that the loader arms and the implement are moved from their current position to the pre-defined loading position within the at least one work cycle time.

6. The method of claim 5, further comprising receiving an operator input instructing the computing device to automatically control the operation of the lift assembly in a manner so that the loader arms and the implement are moved from their current position to the pre-defined loading position.

7. The method of claim 1, further comprising receiving an operator input instructing the computing device to monitor the cycle times for moving the work vehicle between the first and second locations as the material moving operation is being performed.

8. The method of claim 1, wherein the first location is defined at or adjacent to a source of material to be moved and the second location is defined at or adjacent to where the material is being moved.

9. A system for automatically controlling the operation of a work vehicle during the performance of a material moving operation, the system comprising:

a drive unit configured to move the work vehicle between a first location and a second location, the first location being spaced apart from the second location such that a horizontal travel distance is defined between the first and second locations;

a lift assembly including a pair of loader arms and an implement coupled to the loader arms; and a controller communicatively coupled to the drive unit and the lift assembly, the controller including a processor and a memory, the memory storing instructions that, when implemented by the processor, configure the controller to:

monitor cycle times for moving the work vehicle between the first and second locations as the material moving operation is being performed;

determine at least one work cycle time for moving the work vehicle between the first and second locations based on the monitored cycle times;

automatically select an operational speed for the lift assembly based on the at least one work cycle time; and automatically control the operation of the lift assembly based on the selected operational speed such that the loader arms and the implement are moved to a pre-defined loading position as the work vehicle is moved from the first location to the second location and to a pre defined unloading position as the work vehicle is moved from the second location to the first location.

10. The system of claim 9, wherein the at least one work cycle time corresponds to an average cycle time determined based on the monitored cycle times.

11. The system of claim 9, wherein the controller is configured to select the operational speed based on the at least one work cycle time such that the loader arms and the implement are moved from their current position to the pre-defined unloading position within the at least one work cycle time.

12. The system of claim 11, wherein the controller is further configured to receive an operator input instructing it to automatically control the operation of the lift assembly in a manner so that the loader arms and the implement are moved from their current position to the pre-defined unloading position.

13. The system of claim 9, wherein the controller is configured to select the operational speed based on the at least one work cycle time such that the loader arms and the implement are moved from their current position to the pre-defined loading position within the at least one work cycle time.

14. The system of claim 13, wherein the controller is further configured to receive an operator input instructing it to automatically control the operation of the lift assembly in a manner so that the loader arms and the implement are moved from their current position to the pre-defined loading position.

15. The system of claim 9, wherein the controller is further configured to receive an operator input instructing it to monitor the cycle times for moving the work vehicle between the first and second locations as the material moving operation is being performed.

16. The system of claim 9, wherein the first location is defined at or adjacent to a source of material to be moved and the second location is defined at or adjacent to where the material is being moved.

17. The system of claim 9, wherein the at least one work cycle time includes first work cycle time associated with moving the work vehicle from the first location to the second location and a second work cycle time associated with moving the work vehicle from the second location to the first location, the first work cycle time differing from the second work cycle time.

18. The system of claim 17, wherein the controller is configured to automatically select a first operational speed for the lift assembly based on the first work cycle time and a second operational speed for the lift assembly based on the second work cycle time, the controller being further configured to:

automatically control the operation of the lift assembly based on the first operational speed such that the loader arms and the implement are moved to the pre-defined loading position as the work vehicle is moved from the first location to the second location; and automatically control the operation of the lift assembly based on the second operational speed such that the loader arms and the implement are moved to the pre-defined unloading position as the work vehicle is moved from the second location to the first location.

19. The method of claim 1, wherein the at least one work cycle time includes a first work cycle time associated with moving the work vehicle from the first location to the second location and a second work cycle time associated with moving the work vehicle from the second location to the first location, the first work cycle time differing from the second work cycle time.

20. The method of claim 19, wherein automatically controlling the operation of the lift assembly based on the selected operational speed comprises:

automatically controlling the operation of the lift assembly based on the first operational speed such that the loader arms and the implement are moved to the pre-defined loading position as the work vehicle is moved from the first location to the second location; and automatically controlling the operation of the lift assembly based on the second operational speed such that the loader arms and the implement are moved to the pre-defined unloading position as the work vehicle is moved from the second location to the first location.

21. A method for automatically controlling the operation of a work vehicle during the performance of a material moving operation, the work vehicle include a lift assembly having a pair of loader arms coupled to an implement, the method comprising:

monitoring, with a computing device, cycle times for moving the work vehicle between a first location and a second location as the material moving operation is being performed, the first location being spaced apart from the second location such that a horizontal travel distance is defined between the first and second locations;

determining, with the computing device, a first work cycle time for moving the work vehicle from the first location to the second location based on the monitored cycle times;

determining, with the computing device, a second work cycle time for moving the work vehicle from the second location to the first location based on the monitored cycle times;

automatically selecting, with the computing device, a first operational speed for the lift assembly based on the first work cycle time and a second operational speed for the lift assembly based on the second work cycle time;

automatically controlling, with the computing device, the operation of the lift assembly based on the first operational speed such that the loader arms and the implement are moved to a pre-defined loading position as the work vehicle is moved from the first location to the second location; and automatically controlling, with the computing device, the operation of the lift assembly based on the second operational speed such that the loader arms and the implement are moved to a predefined unloading position as the work vehicle is moved from the second location to the first location.

* * * * *